US011591722B2

(12) United States Patent
Quigley

(10) Patent No.: US 11,591,722 B2
(45) Date of Patent: Feb. 28, 2023

(54) WOVEN STRUCTURED FABRIC WITH CROSSING TWILL LINES

(71) Applicant: VOITH PATENT GMBH, Heidenheim (DE)

(72) Inventor: Scott D. Quigley, Bossier City, LA (US)

(73) Assignee: Voith Patent GmbH, Heidenheim (DE)

( * ) Notice: Subject to any disclaimer, the term of this patent is extended or adjusted under 35 U.S.C. 154(b) by 45 days.

(21) Appl. No.: 17/372,661

(22) Filed: Jul. 12, 2021

(65) Prior Publication Data

US 2023/0011606 A1 Jan. 12, 2023

(51) Int. Cl.

*D03D 1/00* (2006.01)
*D03D 13/00* (2006.01)
*D03D 3/04* (2006.01)

(52) U.S. Cl.

CPC ..... *D03D 13/004* (2013.01)

(58) Field of Classification Search

CPC ..... D21F 1/0045; D21F 7/08; D21F 7/083; D21F 1/0027; D21F 1/80; D03D 11/00; D03D 1/00; D03D 13/00; D03D 13/004; D03D 3/04; D03D 1/0094; D03D 25/00; D03D 11/02

See application file for complete search history.

(56) References Cited

U.S. PATENT DOCUMENTS 3,211,606 A 10/1965 Watson
4,161,195 A 7/1979 Khan
4,518,644 A * 5/1985 Vuorio ..... B01D 39/083 162/903
4,998,569 A * 3/1991 Tate ..... D21F 1/0027 162/903
5,544,678 A * 8/1996 Barrett ..... D21F 1/0045 139/383 A
5,988,229 A * 11/1999 Quigley ..... D21F 1/0036 139/383 A
6,148,869 A * 11/2000 Quigley ..... D21F 1/0036 139/383 A
6,227,256 B1 * 5/2001 Quigley ..... D21F 1/0036 139/383 A (Continued)

FOREIGN PATENT DOCUMENTS

DE 2853564 A1 6/1979
DE 3044762 A1 5/1982
GB 2078802 A 1/1982

*Primary Examiner* — Robert H Muromoto, Jr.
(74) *Attorney, Agent, or Firm* — Laurence A. Greenberg; Werner H. Sterner; Ralph E. Locher

(57) ABSTRACT

A woven fabric for use in a machine to produce a fiber web, such as a tissue fiber web. A paper side of the fabric has warp yarns and weft yarns interwoven in a weave pattern, and twill lines, each formed by neighboring warp yarn flotations. Each warp yarn flotation of the weave pattern that contributes to the formation of the twill lines passes over a first weft yarn, which passes over a first warp yarn that directly neighbors the warp yarn flotation on a first side and passes below a second warp yarn that directly neighbors the warp yarn flotation on a second side opposite the first side. The warp yarn flotation also passes over a second weft yarn that directly neighbors the first weft yarn, and the second weft yarn passes below the first warp yarn and over the second warp yarn.

8 Claims, 3 Drawing Sheets

(56) References Cited

U.S. PATENT DOCUMENTS

| | | | | |
|---|---|---|---|---|
| 6,334,467 | B1 * | 1/2002 | Barrett | D21F 1/0036 162/902 |
| 7,059,359 | B2 * | 6/2006 | Quigley | D21F 1/0036 162/348 |
| 2004/0231745 | A1 * | 11/2004 | Quigley | D21F 1/0045 139/383 A |
| 2004/0238062 | A1 * | 12/2004 | Quigley | D21F 1/0045 139/383 A |
| 2007/0068590 | A1 * | 3/2007 | Quigley | D21F 1/0045 139/383 A |
| 2008/0196784 | A1 * | 8/2008 | Quigley | D21F 1/0045 139/383 R |
| 2018/0119352 | A1 * | 5/2018 | Chaplin | D21F 1/0045 |
| 2022/0251741 | A1 * | 8/2022 | Quigley | D21F 1/0027 |

* cited by examiner

WOVEN STRUCTURED FABRIC WITH CROSSING TWILL LINES

BACKGROUND OF THE INVENTION

Field of the Invention

The invention concerns a woven fabric for use in a machine to produce a fiber web, preferably a tissue fiber web, the woven fabric having a machine direction and a cross machine direction, as well as a paper side and a machine side, wherein the paper side is formed by warp yarns and by weft yarns which warp yarns and weft yarns are interwoven with each other in a weave pattern, wherein the paper side comprises a plurality of twill lines, each twill line being formed by a plurality of neighboring warp yarn flotations, wherein each warp yarn flotation of the weave pattern that contributes to the formation of the twill lines passes over a first weft yarn, wherein the first weft yarn passes over a first warp yarn that directly neighbors the warp yarn flotation on a first side and passes below a second warp yarn that directly neighbors the warp yarn flotation on a second side, the second side being opposite the first side, wherein the warp yarn flotation also passes over a second weft yarn that directly neighbors the first weft yarn.

Such woven fabrics are already known in commerce. One example of such a prior art fabric 10' is shown in FIG. 1 which illustrates a view onto the paper side of the fabric 10'. As can be seen the paper side is formed by a plurality of warp yarns interwoven with a plurality of weft yarns. For the sake of clarity only three warp yarns are provided with reference signs, namely WA1', WA' and WA2', and only five weft yarns are provided with reference signs, namely WE1', WE2', WE3', WE4' and WE5'. As in most cases, the fabric is flat woven meaning that the warp yarns extend substantially, but not necessarily exactly, in machine direction MD of the woven fabric 10', whereas the weft yarns extend in cross machine direction CD of the woven fabric 10'. The woven fabric 10' is made endless by a seam, which is not illustrated here. In case the fabric is not flat woven but round woven—which is rather rare—the warp yarns would correspond to the weft yarns and vice versa. Generally speaking, according to the present invention the warp yarns shall refer to the yarns that extend in the machine direction MD of the fabric 10', whereas the weft yarns shall refer to the yarns that extend in the cross machine direction CD of the fabric 10'.

In the illustrated prior art example each warp yarn forms several flotations on the paper side of the woven fabric 10', wherein all flotations have the same length. One of these flotations, or floats, is denominated with reference sign FL' in FIG. 1. This flotation FL' is formed by warp yarn WA' which floats above the five weft yarns WE1'-WE5'. The warp yarn WA' that forms the flotation FL' is neighbored by a first warp yarn WA1' on a first side and by a second warp yarn WA2' on a second side opposite the first side, wherein the first warp yarn WA1' and the second warp yarn WA2' form similar flotations on the paper side of the woven fabric 10' but with an offset. Thus, warp yarn WA1' floats only above weft yarns WE4' and WE5'—and three further weft yarns without reference sign—but not about weft yarns WE1', WE2' and WE3'. The offset results in that directly neighboring flotations of warp yarns together form a diagonal twill line TL' that extends substantially from the lower right side to the upper left side in FIG. 1. In fact, several such twill lines extend parallel to each other across the complete paper side of the woven fabric 10'. The distinctive diagonal twill lines are clearly separated from each other. In the present example between two neighboring twill lines there is some kind of plain weave structure, i.e. a woven structure which is free of any flotations.

Such a woven fabric with diagonal twill lines on its paper side is conducive to sheet building, especially when the sheet is transferred to it with a rush speed differential.

Having a closer look to the five weft yarns WE1'-WE5' which pass below the warp yarn WA' to form the warp yarn flotation FL', it can be seen that the weft yarn WE1' passes over the first warp yarn WA1' and below the second warp yarn WA2', whereas the weft yarn WE2' passes below the first warp yarn WA1' and below the second warp yarn WA2', the weft yarn WE3' passes over the first warp yarn WA1' and over the second warp yarn WA2', the weft yarn WE4' passes below the first warp yarn WA1' and below the second warp yarn WA2' and the weft yarn WE5' passes below the first warp yarn WA1' and over the second warp yarn WA2'.

FIG. 2 shows schematically a cross-sectional view through the fabric 10' of FIG. 1 along the weaving path of the weft yarn WE3'. Due to the fact that the weft yarn WE3' forms some kind of a plain weave structure at the center of the warp yarn flotation FL' by passing over the first warp yarn WA1', below the warp yarn WA' and then again over the second warp yarn WA2', there is created a pressure point at the warp yarn flotation FL'. This pressure point absorbs all of the compressive load applied to the fabric 10' and leads to short life due to monofilament yarn fibrillation. The pointed nature of the warp yarn flotation FL' also makes it difficult to surface sand the fabric to the desired level of contact area on the paper side of the fabric 10' without removing excessive amounts of mass.

BRIEF SUMMARY OF THE INVENTION

It is accordingly an object of the invention to provide a woven fabric which overcomes the above-mentioned disadvantages of the heretofore-known devices and methods of this general type and which avoids, or at least reduces, these problems. In particular the present invention aims to provide a woven fabric that has an enhanced lifetime and is less prone to wear. It is a further object of the present invention to provide a fabric that can be surface sanded to a desired level of contact area at the paper side without removing excessive amounts of mass.

With the above and other objects in view there is provided, in accordance with the invention, a woven fabric for a paper making machine, for example for producing fiber webs, such as tissue paper. The woven fabric has a machine direction, a cross machine direction, a paper side and a machine side, and the fabric comprises:

warp yarns and weft yarns interwoven with one another in a weave pattern;

the paper side being formed with the warp yarns and the weft yarns and the paper side having a plurality of twill lines, each formed by a plurality of neighboring warp yarn flotations;

each of the warp yarn flotations of the weave pattern that contributes to a formation of the twill lines passing over a first weft yarn;

the first weft yarn passing over a first warp yarn that directly neighbors the warp yarn flotation on a first side and passes below a second warp yarn that directly neighbors the warp yarn flotation on a second side opposite the first side;

the warp yarn flotation also passing over a second weft yarn that directly neighbors the first weft yarn; and the second weft yarn passing below the first warp yarn and over the second warp yarn.

In other words, the inventor has found that the problem can be solved by replacing the weft yarn with the plain weave structure—usually provided at the center of the warp yarn flotation—by two weft yarns wherein one of these two weft yarns is the first weft yarn passing over the first warp yarn and below the second warp yarn, whereas the other of these two weft yarns is the second weft yarn passing below the first warp yarn and over the second warp yarn. Thus, these two weft yarns together take over the function of the plain weave structure of the one weft yarn that they substitute, but without any of these two weft yarns in fact forming a plain weave structure. The result is that the fabric has the same number of weft knuckles but the point at the center of the warp yarn flotation is flattened and the pressure point is eliminated.

A positive side effect of this solution is that the elimination of the plain weave structure also allows to drive the count of the woven higher which gives the advantage of lower air permeability and leads to better and less fiber bleed through.

In a preferred embodiment the first weft yarn passes below the warp yarn flotation substantially in the center of the warp yarn flotation. In this context the word "substantially" means that either—if the warp yarn flotation passes over an odd number of weft yarns—the first weft yarn should be in middle one of the odd number of weft yarns (e.g. the fifth weft yarn of nine such weft yarns), or—if the warp yarn flotation passes over an even number of weft yarns—the first weft yarn should be next to the middle of the even number of weft yarns (e.g. the fifth or sixth weft yarn of ten such weft yarns).

Preferably, all weft yarns that pass below the warp yarn flotation also pass below either one or both of the first warp yarn and the second warp yarn. In other words, none of these weft yarns form a plain weave structure with the warp yarn of the warp yarn flotation and the first and second warp yarns. Thus, the creation of a pressure point can be avoided.

In a preferred embodiment all warp yarn flotations of the weave pattern that contribute to the formation of the twill lines have the same length. The length of the warp flotations is preferably at least 5 and can be for example 9 or 10.

Other features which are considered as characteristic for the invention are set forth in the appended claims.

Although the invention is illustrated and described herein as embodied in woven structured fabric with crossing twill lines, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
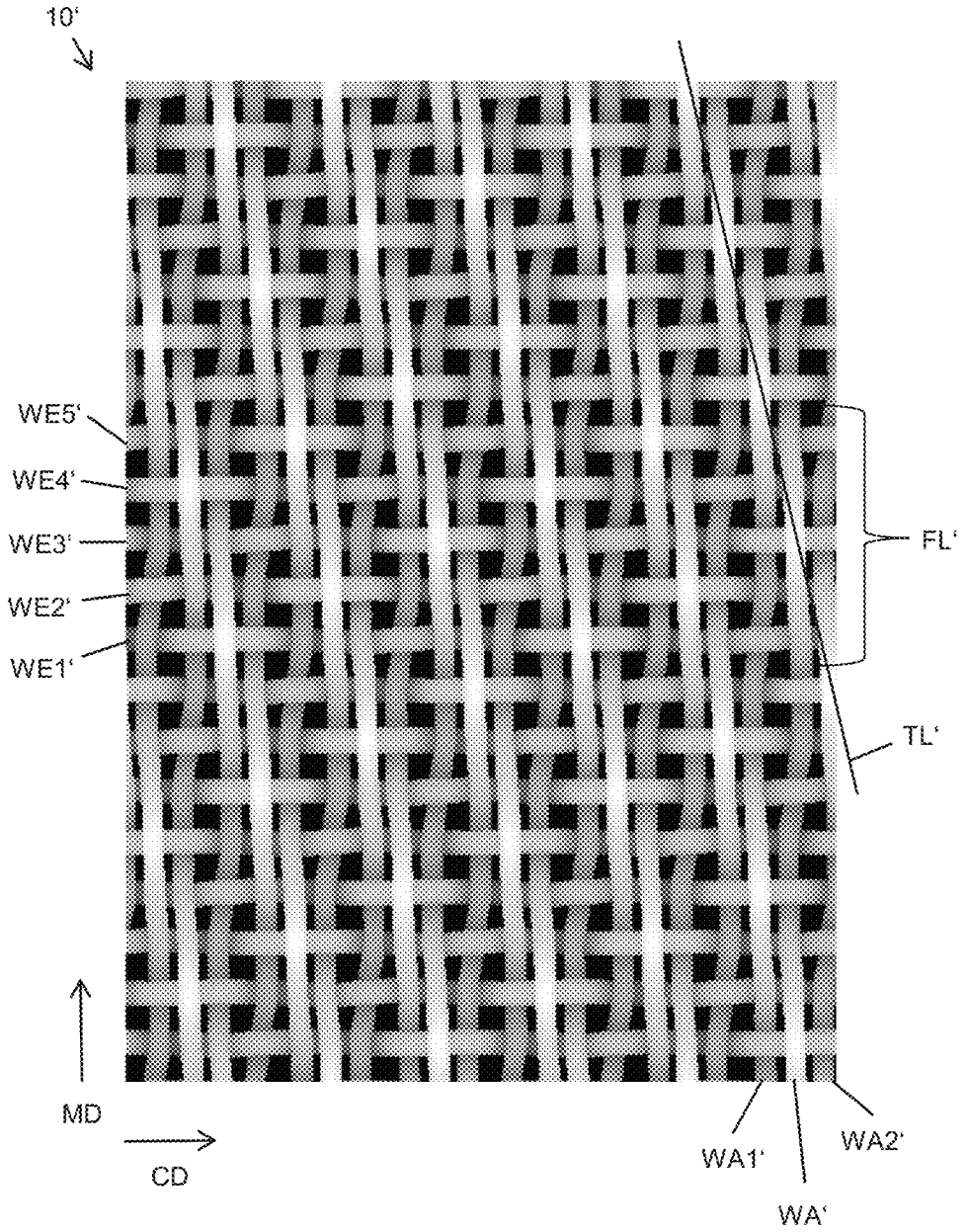
Fig. 1 (prior art)
FIG. 1 is a partial view of a prior art woven fabric in a plan view onto the paper side of the fabric.
Figure 2:
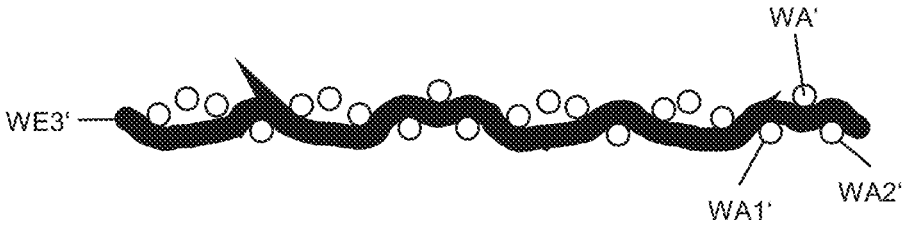
Fig. 2 (prior art)
FIG. 2 is a diagrammatic section taken along the weave line of one of the weft yarns in FIG. 1, along the cross machine direction.
Figure 3:
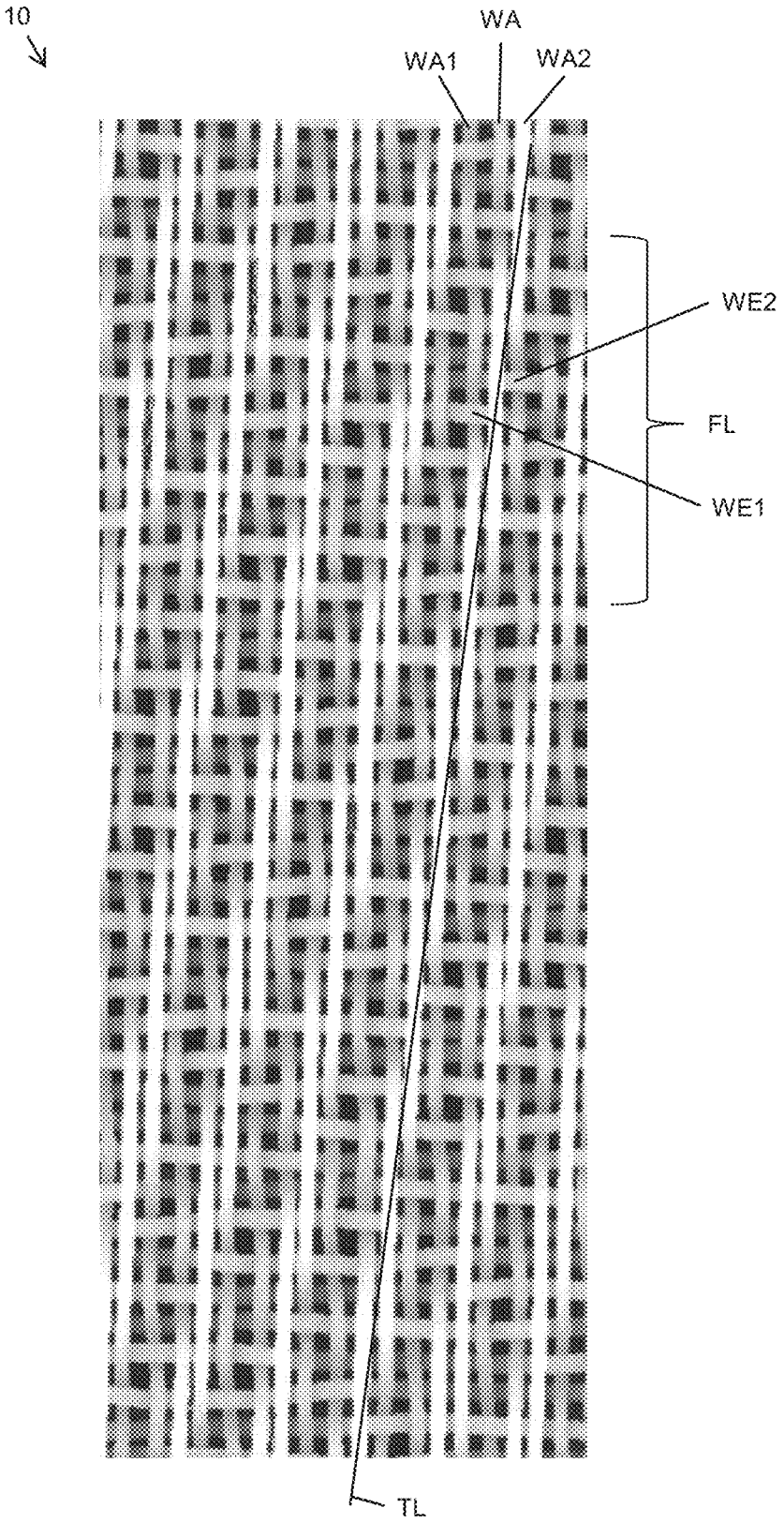
FIG. 3 shows a plan view on the paper side of a portion of a fabric according to a first embodiment of the present invention.

Referring now once more to the figures of the drawing in detail, a first embodiment of the present invention is shown in FIG. 3, which illustrates a view on the paper side of a portion of a woven fabric 10. The exemplary fabric is a forming fabric in a paper making machine and the fabric, or clothing, is suitable to form paper webs, such as tissue paper. The paper side, which is opposite the machine side, is formed by a plurality of warp yarns interwoven with a plurality of weft yarns. Since the woven fabric 10 is a single layer fabric the same warp yarns and weft yarns also form the machine side of the woven fabric 10. For the sake of clarity only three warp yarns are provided with reference signs, namely WA1, WA and WA2, and only two weft yarns are provided with reference signs, namely WE1, WE2. The fabric is flat woven meaning that the warp yarns extend substantially, but not all necessarily exactly, in machine direction MD of the woven fabric 10, whereas the weft yarns extend in cross machine direction CD of the woven fabric 10. The woven fabric 10 is made endless by a not shown seam. In case the fabric is not flat woven but round woven the warp yarns would correspond to the weft yarns and vice versa.

Each warp yarn forms serval flotations, or floats, on the paper side of the woven fabric 10. The long flotations that have a length of 11 in this exemplary embodiment are referred to as warp yarn flotations in the following. Directly neighboring warp flotations form diagonal twill lines TL, or oblique twill lines TL, on the paper side of the fabric 10.

One of these warp yarn flotations is designated with reference sign FL in FIG. 3. The warp yarn flotation FL is formed by warp yarn WA floating over eleven weft yarns. The middle one of these eleven weft yarns is referred to as first weft yarn WE1 in the following. The first weft yarn WE1 passes over a first warp yarn WA1 which first warp yarn WA1 directly neighbors the warp yarn WA that forms the warp yarn flotation FL on a first side, namely on the left-hand side in FIG. 3. Furthermore, the first weft yarn WE1 passes below a second warp yarn WA2 which second warp yarn WA2 directly neighbors the warp yarn WA that forms the warp yarn flotation FL on a second side, namely on the right-hand side in FIG. 3.

The first weft yarn WE1 has a directly neighboring weft yarn which is referred to as second weft yarn WE2 in the following. Differently to the first weft yarn WE1, the second weft yarn WE2 passes below the first warp yarn WA1 and over the second warp yarn WA2.

None of the weft yarns that pass below the warp yarn flotation FL passes above both, the first warp yarn WA1 and the second warp yarn WA2.

Figure 4:
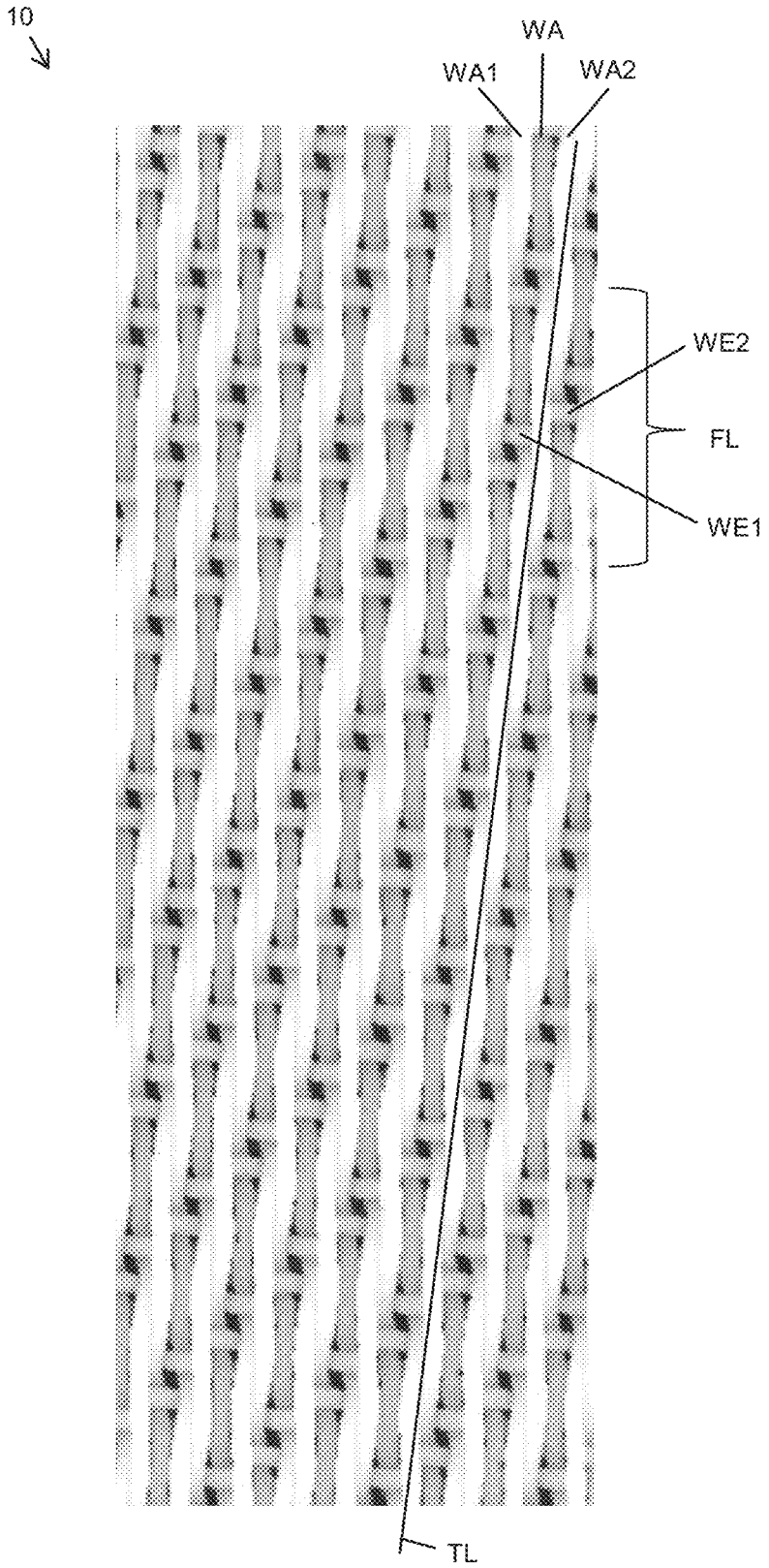
FIG. 4 shows a view on the paper side of a portion of a fabric according to a second embodiment of the present invention.

FIG. 4 shows a view on the paper side of a portion of a woven fabric according to a second embodiment of the present invention. This embodiment is very similar to the first embodiment. The main difference is that the length of the warp yarn flotations that form diagonal twill lines is different. In this exemplary embodiment the length is ten, i.e., the respective warp yarns float above 10 weft yarns. Therefore, the same reference signs are used as in the first embodiment. With regard to the details of this second embodiment, reference is had to the description of the first embodiment which largely also applies to the second embodiment. The first weft yarn WE1 passes below the warp yarn flotation FL substantially at its center. In fact the precise middle would be between the first weft yarn WE1 and its directly neighboring second weft yarn WE2.

The following is a summary list of reference numerals and the corresponding structure used in the above description of the invention:

10 woven fabric
10' woven fabric (prior art)
CD cross machine direction
FL warp yarn flotation
FL' warp yarn flotation (prior art)
MD machine direction
TL diagonal twill line
TL' twill line (prior art)
WA1-WA2 first and second warp yarns
WA1'-WA2' first and second warp yarns (prior art)
WA warp yarn (forming the warp yarn flotation FL)
WA' warp yarn (forming the warp yarn flotation FL') (prior art)
WE1-WE2 first and second weft yarns
WE1'-WE5' weft yarns (prior art)

The invention claimed is:

1. A woven fabric for a paper making machine, the woven fabric comprising:

a multiplicity of warp yarns and weft yarns interwoven with one another in a weave pattern, defining a machine direction and a cross machine direction, a paper side and a machine side of the fabric;

said paper side being formed with said warp yarns and said weft yarns and said paper side having a plurality of twill lines, each formed by a plurality of neighboring warp yarn flotations;

each of said warp yarn flotations of said weave pattern that contributes to a formation of said twill lines passing over a first weft yarn;

said first weft yarn passing over a first warp yarn that directly neighbors said warp yarn flotation on a first side and passes below a second warp yarn that directly neighbors said warp yarn flotation on a second side opposite the first side;

said warp yarn flotation also passing over a second weft yarn that directly neighbors said first weft yarn; and said second weft yarn passing below said first warp yarn and over said second warp yarn.

2. The woven fabric according to claim 1, configured for producing a tissue fiber web.

3. The woven fabric according to claim 1, wherein said first weft yarn passes below said warp yarn flotation substantially in a center of said warp yarn flotation.

4. The woven fabric according to claim 1, wherein all weft yarns that pass below said warp yarn flotation also pass below either one or both of said first warp yarn and said second warp yarn.

5. The woven fabric according to claim 1, wherein all warp yarn flotations of the weave pattern that contribute to the formation of said twill lines have the same length.

6. The woven fabric according to claim 5, wherein the length of said warp yarn flotations is at least 5.

7. The woven fabric according to claim 6, wherein the length of said warp yarn flotations is 9.

8. The woven fabric according to claim 7, wherein the length of said warp yarn flotations is 10.

* * * * *